United States Patent [19]

Findlay et al.

[11] 4,453,839

[45] Jun. 12, 1984

[54] LAMINATED THERMAL TRANSFER MEDIUM FOR LIFT-OFF CORRECTION AND EMBODIMENT WITH RESISTIVE LAYER COMPOSITION INCLUDING LUBRICATING CONTACT GRAPHITE COATING

[75] Inventors: Hugh T. Findlay; Keith A. Jones, both of Lexington, Ky.

[73] Assignee: International Business Machines Corporation, Armonk, N.Y.

[21] Appl. No.: 388,555

[22] Filed: Jun. 15, 1982

[51] Int. Cl.[3] ..... B41J 3/20

[52] U.S. Cl. ..... 400/120; 400/240.1; 400/241.1; 400/696; 428/913; 428/914

[58] Field of Search ..... 400/119, 241.2, 120, 400/241.1, 696, 237, 240.1; 252/9, 11, 22, 29, 252/8.6; 423/448; 427/180, 384; 428/244, 352, 408, 428/423.1, 424.7, 424.8, 488, 900, 914, 913

[56] References Cited

U.S. PATENT DOCUMENTS

| | | | |
|---|---|---|---|
| 3,170,809 | 5/1982 | Barbour | 428/488 |
| 3,301,697 | 1/1967 | Russell | 427/146 X |
| 3,337,361 | 1/1964 | La Count | 427/384 X |
| 3,519,456 | 7/1970 | Reed et al. | 400/241.1 X |
| 3,539,424 | 11/1970 | Tashlick | 428/914 X |
| 3,660,145 | 5/1972 | Johnson et al. | 428/423.1 X |
| 3,924,728 | 12/1975 | Brown et al. | 400/240.1 X |
| 4,103,066 | 7/1978 | Brooks et al. | 400/120 X |
| 4,253,775 | 3/1981 | Crooks et al. | 400/119 X |
| 4,269,892 | 5/1981 | Shattuck et al. | 400/120 X |
| 4,309,117 | 1/1982 | Chang et al. | 400/241.1 |
| 4,310,258 | 1/1982 | Scott | 400/237 X |
| 4,320,170 | 3/1982 | Findlay | 400/120 X |
| 4,384,797 | 5/1983 | Anderson et al. | 400/120 X |

FOREIGN PATENT DOCUMENTS

| | | | |
|---|---|---|---|
| 692229 | 8/1964 | Canada | 400/241.1 |

OTHER PUBLICATIONS

Xerox Disclosure Journal, "Self-Supporting Compliant Substrates for Ribbons", Quach, vol. 4, No. 5, Sep./Oct. 1979, p. 675.

IBM Technical Disclosure Bulletin, "Release—Adhesive Interlayers for Lift-off Correction," vol. 24, No. 5 (Oct. 1981), p. 2247 by Anderson et al.

IBM Technical Disclosure Bulletin, "Delayed Tack Ribbon for Laser Transfer and Other Printing," vol. 19, No. 2 (Jul. 1976), p. 672 by Bruce et al.

*Primary Examiner*—Ernest T. Wright, Jr.

*Attorney, Agent, or Firm*—John A. Brady

[57] ABSTRACT

A thermal ribbon particularly suited to be used once for printing at one temperature and for lift-off correction at a lower temperature. The bottom, resistive layer is a blend of an aliphatic polyurethane and a urethane acrylic copolymer with conductive carbon black. The next layer is 1000 angstroms thick aluminum. The next layer is the release layer, of an ethylene organic acid copolymer, a low-melting material. The top layer is an ink layer containing ethylene vinyl acetate and polyethyacrylate. The resistive layer has a light dusting of graphite. Low print currents for both printing and lift-off correction are achieved.

43 Claims, 2 Drawing Figures

LAMINATED THERMAL TRANSFER MEDIUM FOR LIFT-OFF CORRECTION AND EMBODIMENT WITH RESISTIVE LAYER COMPOSITION INCLUDING LUBRICATING CONTACT GRAPHITE COATING

DESCRIPTION

1. Cross Reference to Related Application

An application, Ser. No. 388,554, filed the same date as this application entitled, as amended, "Modified Resistive Layer In Thermal Transfer Medium Having Lubricating Contact Graphite Coating," by Patsy A. Bowlds, Rex D. Fathergill, David P. Dunn, Hugh T. Findlay and Donald W. Stafford, and assigned to the same assignee to which this application is assigned, is directed to graphite at the side of the resistive layer upon which printing electrodes are applied during printing. The preferred embodiment of the invention of this application includes dusted-on graphite, which is the same preferred modification of the resistive layer described and claimed in that application.

2. Technical Field

This invention relates to thermal printing, particularly to lift-off correction and to a resistive layer blend of resins with conductive filler.

Thermal printing of the kind involved is in the nature of non-impact typewriting. Printing is by flow of melted material from a transfer medium which appears similar to a one-use typewriter ribbon. A lower lamination is resistive and the ribbon is contacted by electrodes, for example with point electrodes and a broad area contact electrode. High current densities in the resistive layer at the point electrodes during an applied voltage pulse produce intense local heating. Ink is transferred from the ribbon to paper at localized areas at which heat is generated. Lift-off correction is the physical stripping of a printed character from the paper or other surface on which it is printed.

BACKGROUND ART

U.S. Pat. No. 4,384,797 to Anderson et al, filed Aug. 13, 1981, entitled "Single Laminated Element for Thermal Printing and Lift-Off Correction, Control Therefor and Process," and assigned to the same assignee to which this application is assigned describes and claims lift-off correction using a thermal printer employing intermediate heat for correction. That application discloses a transfer medium which prints in the normal manner having a resistive layer of polycarbonate, an intermediate lamination of aluminum, and a transfer layer formulated to print at normal printing temperatures and to correct at temperatures less than the printing temperatures.

This invention employs the same transfer layer formulation as that application, while achieving printing and correction at substantially lower temperatures. This is achieved by employing a layer which facilitates release between the aluminum and the transfer layer.

U.S. Pat. No. 4,320,170 to Hugh T. Findlay, filed Dec. 8, 1980, entitled "Polyurethane Ribbon For Non-Impact Printing" and assigned to the same assignee to which this application is assigned describes and claims a thermal ribbon having a resistive layer of polyurethane. The best-made embodiment of this invention employs essentially the same resistive layer except that the urethane is blended as a copolymer with ethyl acrylate to provide greater thermal stability.

The essential element of this invention which permits printing and lift-off correction at lower temperatures is the release layer. Such a release layer is disclosed in an article entitled "Release-Adhesive Interlayers For Lift-Off Correction" in *IBM Technical Disclosure Bulletin,* Vol. 24, No. 5 (October 1981), page 2247 by C. W. Anderson et al. That article discloses ethylene acrylic acid copolymer as one interlayer material, which material is believed to be essentially identical with the material of the preferred embodiment of this invention. The basic difference between that article and the invention here described and claimed is in the characteristics of the ink layer. That ink layer was a polyamide (misspelled polyamid in the publication), carbon black, and a plasticizer blended to be of high viscosity under heat. That ink material does not function at intermediate heat to become tacky for lift-off correction of characters printed from the ink. Lift-off correction of the polyamide ink is by a separate adhesive element, such as by a conventionally used adhesive tape. The subject invention improves a prior art ribbon which both prints at normal temperature and corrects at a lower temperature.

An interlayer in a thermal printing system employing an adhesive top layer is disclosed in an article entitled "Delayed Tack Ribbon for Laser Transfer and Other Printing," in *IBM Technical Disclosure Bulletin,* Vol. 19, No. 2 (July 1976) page 672 by C. A. Bruce and C. E. Stratton. Release layers in conventional transfer mediums are shown in U.S. Pat. Nos. 3,337,361 to La Count and 3,170,809 to Barbour. Polymers as the resistive layer in a thermal ribbon having urethane and non-urethane major parts are shown in the prior art in U.S. Pat. No. 4,269,892 to Shattuck et al.

DISCLOSURE OF THE INVENTION

In accordance with this invention a transfer medium for thermal printing has a release layer of low-melting material between the ink layer containing marking material and the support layer for the marking material. In certain embodiments the material of the release layer is primarily or entirely a polymeric alkane. The material of the marking layer preferably is that formulated for lift-off correction of printing from the same ribbon at intermediate temperatures, and the intermediate layer permits both printing and correction to be accomplished at substantially lower temperatures. In a still more specific aspect of the preferred embodiment the electrically resistive substrate layer comprises a polymeric urethane and polymeric ethyl acrylate.

The effectiveness of the lift-off correction at intermediate heat is both unexpected and a significant advantage in that injury to the ribbon during printing by heat is dramatically reduced. Print-current reduction of 40% or more is realized while lift-off correction at lower temperatures remains effective. This results because the release layer permits printing at lower temperatures.

Heat injury to thermal ribbons during printing can be a major problem. Some degradation of the ribbon may be tolerable where the ribbon is to be used only once, but in any case the ribbon usually must remain physically united sufficient to be moved from the printing area during printing. Typically, the ribbon must be wound on a take-up spool. For many ribbons, desired printing requires temperatures which melt or burn holes in the resins of the resistive layer. With the intermediate layer of this invention, equivalent functioning is achieved at lower currents and correspondingly lower temperatures. Degradation of the ribbon within tolerable limits might still be accepted with the use of this invention when currents and corresponding temperatures are increased to increase overall printing speed. In the specific embodiment, temperature resistance is further enhanced by the resistant characteristics of the ethyl acrylate part of the resistive layer.

BRIEF DESCRIPTION OF DRAWING

The details of this invention will be described in connection with the accompanying drawing, in which.

BEST MODE FOR CARRYING OUT THE INVENTION

Figure 1:
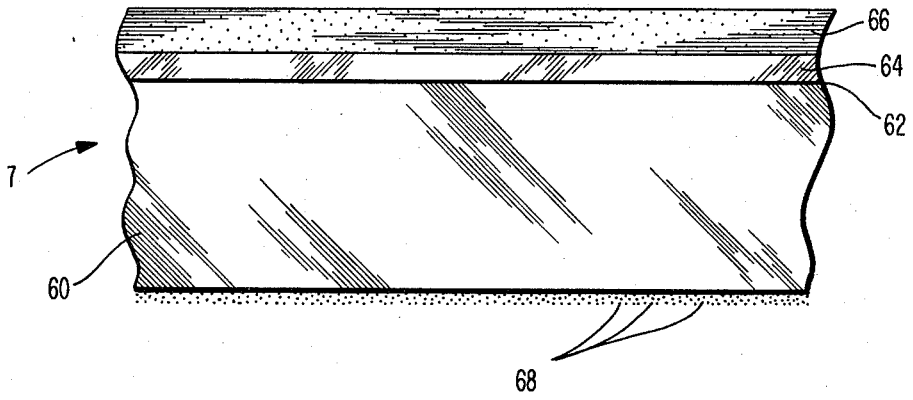
FIG. 1 is a side view of the ribbon in accordance with this invention and FIG. 2 illustrates the manner of graphite coating.
Figure 2:
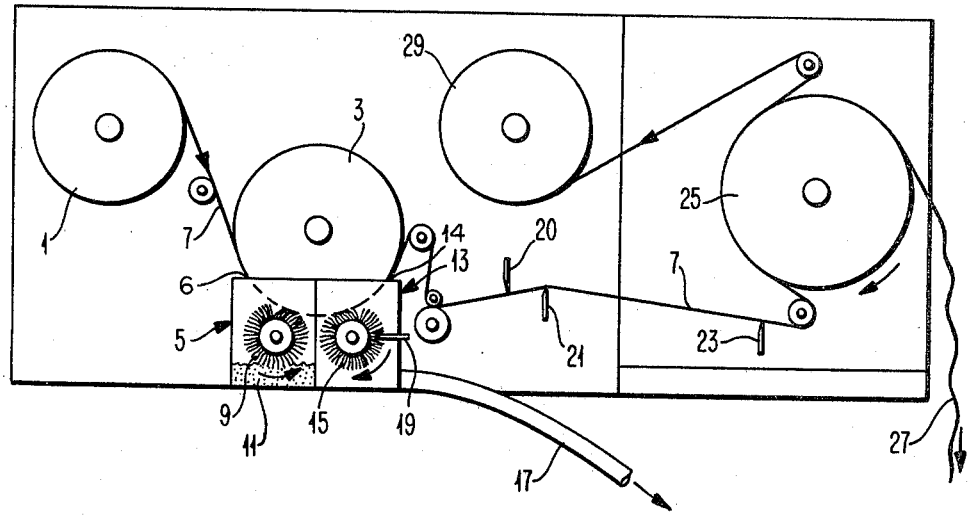

The ribbon 7 which is the preferred and best embodiment of this invention is a four-layer lamination of regular cross-section particularly suited to be used once for printing at one temperature and for lift-off correction using the same ribbon at a lower temperature. The bottom layer 60 is a blend of an aliphatic polyurethane and a urethane acrylic copolymer with conductive, particulate carbon black, which acts as a resistive layer 60. The resistive layer 60 is 17 microns in thickness. The next layer 62 is a 1000 angstroms thick layer 62 of vacuum-deposited aluminum. The next layer 64 is the release layer 64, which is 2 microns in thickness. Finally, on the release layer 64 is a 4 microns thick ink layer 66 flowable in response to heat created by electric current applied from the outside of the resistive layer 60. The outside of the resistive layer 60 carries graphite 68 (greatly magnified in the drawing and illustrated as dots) which has been dusted on and burnished, resulting in an outer deposit of graphite 68 too small to quantify by conventional measuring techniques.

Printing is effected by known techniques in which the resistive layer 60 is contacted with point electrodes (9 in U.S. Pat. No. 4,384,797, discussed in some detail in the next paragraph). The aluminum layer 62 (or, alternatively, the resistive layer 60) is contacted with a broad area electrode (32 or 30 in U.S. Pat. No. 4,384,797). The point electrodes (9 in U.S. Pat. No. 4,384,797) are selectively driven in the form of the images desired with sufficient current to produce local heating which causes transfer of ink from the ribbon 7 to a paper or other substrate (5 in U.S. Pat. No. 4,384,797) in contact with the ribbon.

Lift-off correction is as described in the foregoing U.S. Pat. No. 4,384,797. The erase operation is effected over an incorrect character in the manner of printing, but with the currents being at a predetermined amount which is less than that to cause printing. The ribbon 7 is not stripped away until after a cooling period. The correction operation may be in a manner otherwise identical with ordinary printing of the incorrect character or it may be with the activation of all printing electrodes (9 in U.S. Pat. No. 4,384,797) (block erase) where the return to the incorrect character may be slightly out of registration. During correction the printing speed may be reduced, but this is a non-essential design alternative.

The graphite 68 applied by dusting is as described and claimed in Ser. No. 388,554, by Bowlds et al, in the application filed the same day as this application and discussed under the heading "Cross Reference to Related Application" above. The graphite 68 does not function to greatly reduce printing current but does reduce damage from interface effects between the electrodes (9 in U.S. Pat. No. 4,384,797) and the resistive layer 60. The graphite 68 is believed to form a low resistance electrical, sparking-minimizing connection between the electrodes of the printhead (7 in U.S. Pat. No. 4,384,797) and the body of the polyurethane-ethyl acrylate resistive layer 60 or other resistive layer 60. The graphite 68 also functions as a solid lubricant to reduce friction. It also functions to loosen material which builds-up at the printhead. The substantial advantages of the intermediate release layer 64 in reducing current have been observed in ribbons not having the graphite 68.

THE RESISTIVE LAYER

The dry ingredients of the resistive layer 60 by weight are as follows.

| Resistive Layer - Dry Ingredients | |
|---|---|
| Material | % By Weight |
| (1) Aliphatic Polyurethane | 37.5 |
| (2) Urethane - Ethyl Acrylate Copolymer | 37.5 |
| (3) Conductive Carbon Black | 25.0 |

The aliphatic polyurethane is the dry ingredient of Neorez R-960, trademark of Polyvinyl Chemical Industries. The urethane appears to have few polar or reactive functional groups other than the urethane linkages. Nevertheless, the material is described by its manufacturer as suited to be cross-linked at carboxyl functional groups in the urethane.

The copolymer is the dry ingredient of UXP102, trademark of Polyvinyl Chemical Industries. That is a copolymer of 50% by molecule weight urethane and 50% by molecule weight ethyl acrylate.

The preferred resistive layer 60 is cast from a predominantly water borne dispersion. The following formula for the dispersion is prepared by mixing and grinding the ingredients together in a standard, high-shear mixer until particle wetting is complete, typically one hour for small batches.

| Resistive Layer - Dispersion Formula | |
|---|---|
| Ingredient | % By Weight |
| (1) Neorez R-960* (Polyvinyl Chemical Industries aliphatic urethane dispersion) | 34.6 |
| (2) XC72R (Cabot Co. conductive carbon black) (100% solid particles with exceptionally high surface area) | 7.8 |
| (3) UXP102** (Polyvinyl Chemical Industries copolymer of urethane and ethyl acrylate) | 34.6 |
| (4) Water (additional to water in above) | 23.0 |

*Neorez R-960 consists of the following, by weight 33%: aliphatic urethane; 15% N—methyl-2-pyrrolidone; 1.2% ethylamine; and 50.8% water.

**UXP102 consists of the following by weight: 33% copolymer of 50% by molecule weight urethane and 50% by molecule weight ethyl acrylate; 1.2% ethylamine; and 65.8% water.

The resistive layer 60 dispersion is cast by a reverse roll coater onto a temporary release substrate. This may be a 4 millimeter thick polypropylene or polyethylene terephthalate (Imperial Chemical Industries) film. Drying is then conducted by forced hot air. The upper surface is then metalized by vacuum deposition of aluminum 62 to a thickness of 1000 angstroms.

The intermediate, release layer 64 is then deposited on the aluminum 62. This is also applied as a water-borne dispersion from a reverse roll coater.

RELEASE LAYER

The referred release layer 64 is ethylene organic acid copolymer of 95% by weight ethylene and 5% by weight organic acid. This material is cast from an emulsion.

The material used is commercially obtained as Esi-Cryl 2540-N, a product of Emulsion System Inc. This is a 25% solids emulsion of water and a non-ionic surfactant. The organic acid part of the polymer appears to be acrylic acid. The copolymer is of molecular weight of 3000 to 3500 and has a softening point of 108° C.

The Esi-Cryl 2540-N is coated without modification on the aluminum 62 using a reverse roll coater. Drying is then conducted by forced hot air.

Very satisfactory results have been achieved by using a linear crystalline polyethylene as the material of intermediate layer 64.

The material used is commercially obtained as Poly Emulsion 316 N30, a product of Chemical Corporation of America. This is an aqueous emulsion of the polyethylene, which is characterized by a high degree of slip and hardness, and by a high melt viscosity.

It is coated and used as the release layer 64 as described for the preferred ethylene organic acid copolymer.

Ink Layer Formula

| Component | Parts by Weight | % Solids |
|---|---|---|
| Adcote 37JD610 (An ethylene vinyl acetate copolymer of 6300 weight average molecular weight; approximately 90% by weight being the polyethylene component; with about 6% by weight rosin acids as dispersants: 40% total solids in water; trademark product of Morton Chemical Co.) | 6 | 73.4 |
| Hycar 2600X120 (Polyethylacrylate, with about 4% by weiqht polyacrylonitrile, some dispersant; 50% solids in water; trademark product of B. F. Goodrich Chemical Co.) | 1 | 15.3 |
| Aquablack 140 (Carbon black, 7% by weight naphthalene sulfonic acid dispersant; 37% solids in water; trademark product of Bordon Chemical, Division of Bordon Inc.) | 1 | 11.3 |
| Water (distilled, additional to water in foregoing) | 1 | — |

The foregoing intermediate layer 64 is overcoated using a reverse roll coater with the ink layer 66 formula in an amount to produce the desired dry thickness. Drying by evaporation of the water vehicle is then conducted using forced hot air. The combined polyurethane-acrylate resistive layer 60 with intermediate layers 62,64 and top ink layer 66 is stripped from the temporary substrate. This is a bulk ribbon 7 to which a minute graphite coating 68 is then applied to the outer surface of the resistive layer 60. After the graphite application, the bulk ribbon 7 is slit to the desired width and wound into a spool.

GRAPHITE APPLICATION

The graphite is an outer layer 68 on the resistive layer 60 and may be applied prior to the application of other parts of the ribbon 7. Typically, it will be applied last, and this discussion assumes the ribbon 7 is otherwise finished when the graphite is applied. The graphite applied is a powder.

The graphite used is the Micro-850 product of Asbury Graphite Mills, Asbury, N.J. This is understood to be the cleanest and smallest in particle size graphite sold commercially by that company, which company is understood to offer a representative range of graphite products. The particle size is understood to be 0.5 to 0.6 micron in average diameter. The graphite is natural as opposed to synthetic and is understood to have an ash content of 1% by weight maximum. (The ash would be primarily silicon oxides and metal oxides and the like, and is essentially the residual extraneous materials from processing.)

The drawing illustrates significant elements of the preferred station to apply the dusted-on graphite layer 68. Mechanical details to turn the mechanisms and direct the bulk ribbon 7 are not specifically indicated as they are not exceptional and may be conventional. The supply roll 1 in a commercial process is an otherwise finished bulk roll as just described. This is fed to a back-up roll 3 with the resistive layer 60 outward.

Back-up roll 3 is situated in applicator tank 5, which is closed except for felt-sealed, small openings 6 to receive ribbon 7 and roll 3. Applicator roll 9 is a paint roll of soft, artificial cloth. Roll 9 rotates continuously during graphite application and physically rubs against ribbon 7. It dips into the graphite powder 11 on the floor of tank 5 and carries graphite 11 in its fibers in the manner of painting. Graphite 11 transfers to ribbon 7 as roll 9 rubs against it. The direction of movement of roll 9 is not important.

Ribbon 7 exits tank 5 having the transferred graphite on its surface. It immediately enters cleaning tank 13. Tank 13 also is closed except for small felt-sealed openings 14 to receive ribbon 7 on roll 3. Cleaning brush 15 in tank 13 rotates in the direction of travel of ribbon 7. The direction of rotation, however, is not important. Brush 15 is also a paint roll of soft cloth, which tends to capture excess graphite 11. Vacuum line 17 pulls graphite 11 from the air in tank 13. After an area of brush 15 leaves the ribbon 7 it encounters beater bar 19, a stationary bar which is positioned to disturb the cloth of brush 15. This shakes loose graphite 11 from brush 15, which is then removed by vacuum line 17.

Ribbon 7 then leaves tank 13 and is guided past one upper, sharp scraper blade 20 and two longitudinally spaced, sharp scraper blades 21 and 23. Blades 20, 21 and 23 may be or have the characteristics of razor blades. Where the operation of cleaning brush 15 or other cleaners is sufficient, scraper blades 20, 21 and 23 may be wholly eliminated. The top blade 20 is for scraping off graphite 11 which settles from the atmosphere from tank 5 around the edges of ribbon 7. Where the bulk ribbon 7 is wide, these edges may be trimmed off. In any event, tension on scraper blades 20, 21 and 23 is very light.

Ribbon 7 is guided around a roll 25 of tissue 27. Tissue 27 may be or have the characteristics of toilet tissue.

The resistive layer 60 side of ribbon 7 covers most of one side of the curved surface of roll 25. Roll 25 moves in the direction of ribbon 7 and at slightly greater velocity (the direction movement is not critical). Tissue 27 is fed away from roll 25 so that the outer surface of roll 25 is continuously renewed. Where the operation of cleaning brush 15 or other cleaners is sufficient, tissue 27 may be wholly eliminated.

The foregoing manufacture results in a final dusting and polishing of graphite 11 which leaves a coating 68 so minute as not to be measureable by ordinary techniques. The graphite 68 remains by inherent surface effects between the graphite 68 and the surface of the resistive layer 60. The silver appearance usually given by graphite 11 does appear on the surface.

The complete ribbon 7 is rolled into a take-up spool 29. That is a bulk roll ready to be slit to the desired width and wound into a spool.

It will be apparent that various modifications can be made in the foregoing without departing from the basic inventive concepts described. Accordingly, patent coverage claimed is as follows.

What is claimed is:

1. A transfer medium for thermal printing comprising a layer of marking material which is non-tacky and cohesive at ordinary room temperatures and which forms a bond for lift-off correction of thermal printing made from said transfer medium after having been raised to temperatures above ordinary room temperatures and below temperatures at which thermal printing by said transfer medium normally is effected, and a support layer upon which said marking material is supported, said transfer medium having a release layer comprising a low-melting material between said marking material and said support layer.

2. The transfer medium as in claim 1 in said release layer is predominantly an alkane.

3. The transfer medium as in claim 1 in which said release layer has a softening point of about 108° C.

4. The transfer medium as in claim 1 in which said marking material is a blend comprising ethylene vinyl acetate copolymer, a compatible acrylic polymer, and carbon black.

5. The transfer medium as in claim 2 in which said marking material is a blend comprising ethylene vinyl acetate copolymer, a compatible acrylic polymer, and carbon black.

6. The transfer medium as in claim 3 in which said marking material is a blend comprising ethylene vinyl acetate copolymer, a compatible acrylic polymer, and carbon black.

7. The transfer medium as in claim 4 in which said support layer comprises a solid polymer with conductive particles dispersed in said polymer and in which said release layer and said polymer are separated by an aluminum layer of thickness in the order of mangitude of 1000 angstroms.

8. The transfer medium as in claim 5 in which said support layer comprises a solid polymer with conductive particles dispersed in said polymer and in which said release layer and said polymer are separated by an aluminum layer of thickness in the order of magnitude of 1000 angstroms.

9. The transfer medium as in claim 6 in which said support layer comprises a solid polymer with conductive particles dispersed in said polymer and in which said release layer and said polymer are separated by an aluminum layer of thickness in the order of magnitude of 1000 angstroms.

10. The transfer medium as in claim 4 in which said marking material is a blend of about 69 parts by weight ethylene vinyl acetate copolymer, about 15 parts by weight of a compatible acrylic polymer, and about 11 parts by weight carbon black.

11. The transfer medium as in claim 5 in which said marking material is a blend of about 69 parts by weight ethylene vinyl acetate copolymer, about 15 parts by weight of a compatible acrylic polymer, and about 11 parts by weight carbon black.

12. The transfer medium as in claim 6 in which said marking material is a blend of about 69 parts by weight ethylene vinyl acetate copolymer, about 15 parts by weight of a compatible acrylic polymer, and about 11 parts by weight carbon black.

13. The transfer medium as in claim 7 in which said marking material is a blend of about 69 parts by weight ethylene vinyl acetate copolymer, about 15 parts by weight of a compatible acrylic polymer, and about 11 parts by weight carbon black.

14. The transfer medium as in claim 8 in which said marking material is a blend of about 69 parts by weight ethylene vinyl acetate copolymer, about 15 parts by weight of a compatible acrylic polymer, and about 11 parts by weight carbon black.

15. The transfer medium as in claim 9 in which said marking material is a blend of about 69 parts by weight ethylene vinyl acetate copolymer, about 15 parts by weight of a compatible acrylic polymer, and about 11 parts by weight carbon black.

16. The transfer medium as in claim 11 in which said release layer consists essentially of a linear crystalline polyethylene.

17. The transfer medium as in claim 12 in which said release layer consists essentially of a copolymer of 95% by weight ethylene and 5% by weight organic acid of molecular weight of about 3000 to 3500.

18. The transfer medium as in claim 14 in which said release layer consists essentially of a linear crystalline polyethylene.

19. The transfer medium as in claim 15 in which said release layer consists essentially of a copolymer of 95% by weight ethylene and 5% by weight organic acid of molecular weight of about 3000 to 3500.

20. A transfer medium for thermal printing comprising a layer of marking material, a support layer upon which said marking material is supported, said marking material being meltable to effect printing by heat supplied from said support layer, said transfer medium having a release layer consisting essentially of a polymeric alkane in contact with said marking material and said support layer.

21. The transfer medium as in claim 20 in which said alkane is a linear crystalline polyethylene.

22. The transfer medium as in claim 21 in which said support layer comprises a solid polymer with conductive particles dispersed in said polymer and in which said release layer and said polymer are separated by an aluminum layer of thickness in the order of magnitude of 1000 angstroms.

23. The transfer medium as in claim 21 in which said marking material is a blend comprising ethylene vinyl acetate copolymer, a compatible acrylic polymer, and carbon black.

24. The transfer medium as in claim 22 in which said marking material is a blend comprising ethylene vinyl acetate copolymer, a compatible acrylic polymer, and carbon black.

25. The transfer medium as in claim 23 in which said marking material is a blend of about 69 parts by weight ethylene vinyl acetate copolymer, about 15 parts by weight of a compatible acrylic polymer, and about 11 parts by weight carbon black.

26. The transfer medium as in claim 24 in which said marking material is a blend of about 69 parts by weight ethylene vinyl acetate copolymer, about 15 parts by weight of a compatible acrylic polymer, and about 11 parts by weight carbon black.

27. A transfer medium for thermal printing comprising a layer of marking material comprising a blend of polymeric alkane and a compatible polymeric acrylic, said marking material being sufficiently cohesive at a first temperature for lift-off correction of thermal printing made from said marking material, said marking material forming a bond for lift-off correction with said printing at a second temperature, said second temperature being higher than said first temperature, a support layer upon which said marking material is supported, and a release layer consisting essentially of a polymer which is predominantly an alkane between said marking material and said support layer.

28. The transfer medium as in claim 27 in which said release layer consists essentially of a copolymer of 95% by weight ethylene and 5% by weight organic acid of molecular weight of about 3000 to 3500.

29. The transfer medium as in claim 27 in which said release layer consists essentially of a linear crystalline polyethylene.

30. The transfer medium as in claim 28 in which said support layer comprises a solid polymer with conductive particles dispersed in said polymer and in which said release layer and said polymer are separated by an aluminum layer of thickness in the order of magnitude of 1000 angstroms.

31. The transfer medium as in claim 29 in which said support layer comprises a solid polymer with conductive particles dispersed in said polymer and in which said release layer and said polymer are separated by an aluminum layer of thickness in the order of magnitude of 1000 angstroms.

32. The transfer medium as in claim 30 in which said marking material is a blend of about 69 parts by weight ethylene vinyl acetate copolymer, about 15 parts by weight of a compatible acrylic polymer, and about 11 parts by weight carbon black.

33. The transfer medium as in claim 31 in which said marking material is a blend of about 69 parts by weight ethylene vinyl acetate copolymer, about 15 parts by weight of a compatible acrylic polymer, and about 11 parts by weight carbon black.

34. A transfer medium for non-impact thermal transfer printing having a thermal transfer layer and an electrically resistive substrate layer, said resistive substrate layer comprising a polymeric urethane, a polymeric acrylate, and an electrically significant amount of conductive, particulate material.

35. The transfer medium as in claim 34 in which said polymeric urethane and said polymeric acrylate comprise a blend of an aliphatic polyurethane and a urethane-ethyl acrylate copolymer.

36. The transfer medium as in claim 35 in which said aliphate polyurethane and said copolymer are in about equal part by weight and said copolymer is about equal part by molecular weight in urethane and ethyl acrylate.

37. The transfer medium as in claim 34 in which said particulate material is carbon black.

38. The transfer medium as in claim 35 in which said particulate material is carbon black.

39. The transfer medium as in claim 36 in which said particulate material is carbon black.

40. The transfer medium as in claim 38 having an aluminum layer of thickness in the order of magnitude of 1000 angstroms on the side of said substrate layer between said substrate layer and said thermal transfer layer.

41. The transfer medium as in claim 39 having an aluminum layer of thickness in the order of magnitude of 1000 angstroms of the side of said substrate layer between said substrate layer and said thermal transfer layer.

42. The transfer medium as in claim 40 in which the thickness of said substrate layer is the order of magnitude of 17 microns.

43. The transfer medium as in claim 41 in which the thickness of said substrate layer is the order of magnitude of 17 microns.

* * * * *